US011257409B1

(12) United States Patent
Xue

(10) Patent No.: US 11,257,409 B1
(45) Date of Patent: Feb. 22, 2022

(54) GATE ON ARRAY CIRCUIT

(71) Applicant: TCL China Star Optoelectronics Technology Co., Ltd., Shenzhen (CN)

(72) Inventor: Yan Xue, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/618,387

(22) PCT Filed: Jul. 22, 2019

(86) PCT No.: PCT/CN2019/097102
§ 371 (c)(1),
(2) Date: Dec. 1, 2019

(87) PCT Pub. No.: WO2020/220480
PCT Pub. Date: Nov. 5, 2020

(30) Foreign Application Priority Data

Apr. 29, 2019 (CN) ..... 201910357621.8

(51) Int. Cl.
*G09G 3/20* (2006.01)

(52) U.S. Cl.
CPC ..... *G09G 3/20* (2013.01); *G09G 2300/0809* (2013.01); *G09G 2310/0267* (2013.01); *G09G 2310/08* (2013.01)

(58) Field of Classification Search
CPC ..... G09G 3/20; G09G 2300/0809; G09G 2310/0267; G09G 2310/08
See application file for complete search history.

(56) References Cited

U.S. PATENT DOCUMENTS

2018/0330687 A1* 11/2018 Zeng ..... G02F 1/13

* cited by examiner

*Primary Examiner* — Christopher J Kohlman
(74) *Attorney, Agent, or Firm* — Nathan & Associates; Nathan Menachem

(57) ABSTRACT

The present disclosure provides a gate on array (GOA) circuit. Each stages of GOA units of the GOA circuit includes a pull-up control unit, a hand-down unit, a feedback unit, a first pull-up unit, a second pull-up unit, a bootstrap capacitor unit, a pull-down unit, and a pull-down control unit. The bootstrap capacitor and the second pull-up unit of the GOA circuit make the first node have a non-symmetrical waveform. The right part of the waveform is as high as the highest voltage potential of the first node so that the decline time of the scan signal is reduced and the performance of the GOA circuit is improved.

10 Claims, 5 Drawing Sheets

GATE ON ARRAY CIRCUIT

FIELD OF INVENTION

The present disclosure relates to a field of display technology, particular to a gate on array (GOA) circuit.

BACKGROUND OF INVENTION

Organic light-emitting diode (OLED) displays possess advantages such as self-luminance, backlight not required, high contrast, thin thickness, wide viewing angles, quick response, flexibility and bendability, wide operating temperature range, and simpler structure and manufacturing processes. Therefore, OLED displays are viewed as a progressive application of flat displays for the next generation.

Gate on array (GOA), i.e. gate driver on array, technology utilizes manufacturing processes of thin-film transistor (TFT) liquid crystal display to dispose gate scan driving circuits on a TFT array substrate for implementing sequential scan driving line by line. Thus, manufacturing cost is reduced and bezel of panel becomes narrower. GOA technology is applied on various displays. GOA circuits perform two basic functions. The first function is outputting gate scan driving signals to drive gate lines of panels and turning on TFTs in display areas for charging pixels. The second function is being a level shifter which sequentially outputs a gate scan driving signal of a next stage under the control of a clock signal after the gate scan driving signal of the present stage is outputted. GOA technology can reduce bonding processes so that the manufacturing cost can be reduced and the liquid crystal display panels are more suitable for narrower bezels.

OLED panels definitely require thinner thickness and variable structure on the basis of a characteristic of self-luminance GOA technology forms scan driving circuits together with the same manufacturing processes as forming the TFTs while an external circuit in GOA technology only provides several signals. Thus, cost of manufacturing is reduced, the yields of modules are enhanced, and the cost of integrated circuits (ICs) is reduced.

For large-size high-resolution display panels, due to the short effective charging time, the falling times of the waveforms outputted by the GOA circuits must be as short as possible. If the falling time is too long, switching TFTs in pixel circuits cannot be turned off in time. The voltage data is difficult to store in the storage capacitor which causes missing charging of data. The conventional method of reducing the charging time is to generate an additional right side waveform symmetrical to an output waveform a node Q. Electric charge is discharged by a buffer TFT. However, the fall times are still too long for high-resolution products thus performance requirements cannot be satisfied.

SUMMARY OF INVENTION

The object of the present disclosure is providing a gate on array (GOA) circuit to reduce a decline time of scan signals so that performance of the GOA circuit is improved.

To achieve the above-mentioned object, the present disclosure provides a GOA circuit including a plurality stages of cascaded GOA units, and each of the GOA units including a pull-up control unit, a hand-down unit, a feedback unit, a first pull-up unit, a second pull-up unit, a bootstrap capacitor unit, a pull-down unit, and a pull-down control unit.

Wherein n is an integer more than 1, in a (n)th GOA unit.

The pull-up control unit is electrically connected to a first node and a second node and configured to receive a stage signal of a (n−1)th GOA unit and a pull-up clock signal for outputting the stage signal of a (n−1)th GOA unit to the first noted and the second node according to a control of the pull-up clock signal.

The hand-down unit is electrically connected to the first node and configured to receive an output clock signal for outputting the output clock signal as a stage signal of a (n)th GOA unit according to a control of the first node.

The feedback unit is electrically connected to the first node, the second node, and a sixth node and configured to receive the output clock signal and the stage signal of the (n)th GOA unit for outputting the output clock signal to the sixth node and the second node according to a control of the stage signal of the (n)th GOA unit and the control of the first node.

The first pull-up unit is electrically connected to the first node and configured to receive the output clock signal for outputting the output clock signal as a scan signal of the (n)th GOA unit according to the control of the first node.

The second pull-up unit is electrically connected to the first node and a third node and configured to receive a down clock signal for outputting the down clock signal to the third node according to the control of the first node.

The bootstrap capacitor unit is electrically connected to the first node, a fourth node, and the third node and configured to receive the scan signal of the (n)th GOA unit, the output clock signal, and the down clock signal for pulling up a voltage of the first node with a rising voltage of the fourth node according to a control of the scan signal of the (n)th GOA unit and a control of the down clock signal, and the rising voltage of the fourth node is caused from a voltage of the scan signal of the (n)th GOA unit and a voltage of the third node.

The pull-down unit is electrically connected to the first node and the second node and configured to receive the scan signal of the (n)th GOA unit, a stage signal of a (n+2)th GOA unit, a first low voltage, and a second low voltage for pulling down the voltage of the first node and a voltage of the second node to the first low voltage and pulling down the voltage of the scan signal of the (n)th GOA unit to the second low voltage according to a control of the stage signal of the (n+2)th GOA unit.

The pull-down control unit is electrically connected to the first node, the second node, a fifth node, and the sixth node and configured to receive the stage signal of the (n)th GOA unit, the first low voltage, and the second low voltage for keeping the voltage of the first node and the voltage of the second node at the first low voltage and pulling down the voltage of the stage signal of the (n)th GOA unit to the first low voltage, and pulling down a voltage of the sixth node to the second low voltage according to a control of the fifth node.

The pull-up control unit includes a first transistor and a second transistor.

A gate of the first transistor is configured to receive the pull-up clock signal, a source of the first transistor is configured to receive the stage signal of the (n−1)th GOA unit, and a drain of the first transistor is electrically connected to the second node.

A gate of the second transistor is configured to receive the pull-up clock signal, a source of the second transistor is electrically connected to the second node, and a drain of the second transistor is electrically connected to the first node.

The hand-down unit includes a third transistor. A gate of the third transistor is electrically connected to the first node, a source of the third transistor is configured to receive the output clock signal, and a drain of the third transistor outputs the stage signal of the (n)th GOA unit.

The feedback unit includes a fourth transistor and a fifth transistor.

A gate of the fourth transistor is electrically connected to the first node, a source of the fourth transistor is configured to receive the output clock signal, and a drain of the fourth transistor is electrically connected to the sixth node.

A gate of the fifth transistor is configured to receive the stage signal of the (n)th GOA unit, source of the fifth transistor is electrically connected to the second node, and a drain of the fifth transistor is electrically connected to the sixth node.

The first pull-up unit includes a sixth transistor.

A gate of the sixth transistor is electrically connected to the first node, a source of the sixth transistor is configured to receive the output clock signal, and a source of the sixth transistor outputs the scan signal of the (n)th GOA unit.

The second pull-up unit includes a seventh transistor.

A gate of the seventh transistor is electrically connected to the first node, a source of the seventh transistor is configured to receive the down clock signal, and a source of the seventh transistor is electrically connected to the third node.

The bootstrap capacitor unit includes a capacitor, an eighth transistor, and a ninth transistor.

A first end of the capacitor is electrically connected to the first node and a second end of the capacitor is electrically connected to the fourth node.

A gate of the eighth transistor is configured to receive the output clock signal, a source of the eighth transistor is electrically connected to the fourth transistor, and a drain of the eighth transistor is configured to receive the scan signal of the (n)th GOA unit.

A gate of the ninth transistor is configured to receive the down clock signal, a source of the ninth transistor is electrically connected to the fourth node, and a drain of the ninth transistor is electrically connected to the third node.

The pull-down unit includes a tenth transistor, an eleventh transistor, and a twelfth transistor.

A gate of the tenth transistor is configured to receive the stage signal of the (n+2)th GOA unit, a source of the tenth transistor is configured to receive the scan signal of the (n)th GOA unit, and a drain of the tenth transistor is configured to receive the second low voltage.

A gate of the eleventh transistor is configured to receive the stage signal of the (n+2)th GOA unit, a source of the eleventh transistor is electrically connected to the first node, and a drain of the eleventh transistor is electrically connected to the second node.

A gate of the twelfth transistor is configured to receive the stage signal of the (n+2)th GOA unit, a source of the twelfth transistor is electrically connected to the second node, and a drain of the twelfth transistor is electrically connected to the first low voltage.

The pull-down control unit includes a thirteenth transistor, a fourteenth transistor, a fifteenth transistor, a sixteenth transistor, a seventeenth transistor, a eighteenth transistor, a nineteenth transistor, a twentieth transistor, and a twenty-first transistor.

A gate of the thirteenth transistor is electrically connected to the fifth node, a source of the thirteenth transistor is electrically connected to the second node, and a drain of the thirteenth transistor is configured to receive the first low voltage.

A gate of the fourteenth transistor is electrically connected to the fifth node, a source of the fourteenth transistor is electrically connected to the first node, and a drain of the fourteenth transistor is electrically connected to the second node.

A gate of the fifteenth transistor is electrically connected to the fifth node, a source of the fifteenth transistor is configured to receive the stage signal of the (n)th GOA unit, and a drain of the fifteenth transistor is configured to receive the first low voltage.

A gate of the sixteenth transistor is electrically connected to the fifth node, a source of the sixteenth transistor is electrically connected to the sixth node, and a drain of the sixteenth transistor is configured to receive the second low voltage.

A gate of the seventeenth transistor is electrically connected to the fifth node, a source of the seventeenth transistor is electrically connected to the sixth node, and a drain of the seventeenth transistor is configured to receive the second low voltage.

Both of a gate of the eighteenth transistor and a source of the eighteenth transistor are configured to receive a high voltage and a drain of the eighteenth transistor is electrically connected to a source of the ninetieth transistor.

A gate of the ninetieth transistor is electrically connected to the first node and a drain of the ninetieth transistor is configured to receive the first low voltage.

A gate of the twentieth transistor is electrically connected to a source of the nineteenth transistor. A source of the twentieth transistor is configured to receive the high voltage. A drain of the twentieth transistor is electrically connected to the fifth node.

A gate of the twenty-first transistor is electrically connected to the first node. A source of the twenty-first transistor is electrically connected to the fifth node. A drain of the twenty-first transistor is configured to receive the first low voltage.

The second low voltage is lower than the first low voltage.

The beneficial effect is of the present disclosure is providing a GOA circuit including a plurality stages of cascaded GOA units, and each of the GOA units including a pull-up control unit, a hand-down unit, a feedback unit, a first pull-up unit, a second pull-up unit, a bootstrap capacitor unit, a pull-down unit, and a pull-down control unit. The bootstrap capacitor and the second pull-up unit of the GOA circuit make the first node have a non-symmetrical waveform. The right part of the waveform is as high as the highest voltage potential of the first node so that the decline time of the scan signal is reduced and the performance of the GOA circuit is improved.

DESCRIPTION OF THE DRAWINGS

The detailed description of the present disclosure is as following accompanying with drawings for the purpose of understanding features and technical solutions of the present disclosure. However, the drawings are only references for understand the present disclosure rather than limitations.

In followings drawings.

DETAILED DESCRIPTION OF PREFERRED EMBODIMENTS

In order to further clarify the technical methods and effects of the present disclosure, the following detailed description will be described with preferred embodiments of the disclosure accompanying with drawings.

Figure 1:
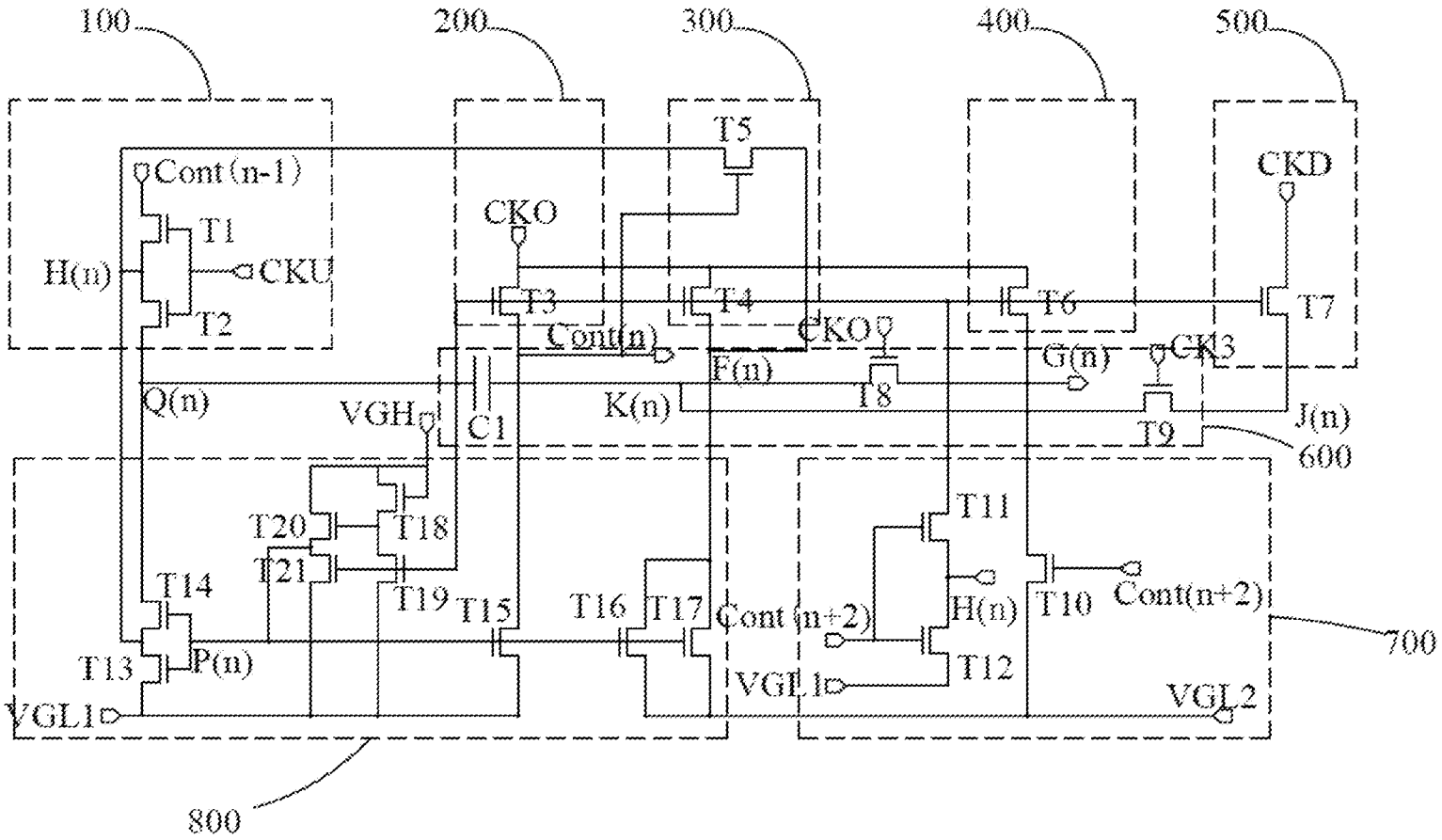
FIG. 1 illustrates a circuit of one stage of gate on array (GOA) unit of a GOA circuit of the present disclosure.

Please refer to FIG. 1. The present disclosure provides a gate on array (GOA) circuit including a plurality stage of GOA units. Each stage of GOA unis includes a pull-up control unit 100, a hand-down unit 200, a feedback unit 300, a first pull-up unit 400, a second pull-down 500, a bootstrap capacitor unit 600, a pull-down unit 700, and a pull-down control unit 800.

When n represents a positive integer being more than 1, in a (n)th GOA unit:

The pull-up control unit 100 is electrically connected to a first node Q(n) and a second node H(n) and configured to receive a stage signal of a (n−1)th GOA unit Cout(n−1) and a pull-up clock signal CKU for outputting the stage signal of a (n−1)th GOA unit Cout(n−1) to the first noted Q(n) and the second node H(n) according to a control of the pull-up clock signal CKU.

The hand-down unit 200 is electrically connected to the first node Q(n) and configured to receive an output clock signal CKO for outputting the output clock signal CKO as a stage signal of the (n)th GOA unit Cout(n) according to a control of the first node Q(n).

The feedback unit 300 is electrically connected to the first node Q(n), the second node H(n), and a sixth node F(n) and configured to receive the output clock signal CKO and the stage signal of the (n)th GOA unit Cout(n) for outputting the output clock signal CKO to the sixth node F(n) and the second node H(n) according to a control of the stage signal of the (n)th GOA unit Cout(n) and the control of the first node Q(n).

The first pull-up unit 400 is electrically connected to the first node Q(n) and configured to receive the output clock signal CKO for outputting the output clock signal CKO as a scan signal of the (n)th GOA unit G(n) according to the control of the first node Q(n).

The second pull-up unit 500 is electrically connected to the first node Q(n) and a third node J(n) and configured to receive a down clock signal CKD for outputting the down clock signal CKD to the third node J(n) according to the control of the first node Q(n).

The bootstrap capacitor unit 600 is electrically connected to the first node Q(n), a fourth node K(n), and the third node J(n) and configured to receive the scan signal of the (n)th GOA unit G(n), the output clock signal CKO, and the down clock signal CKD for pulling up a voltage of the first node Q(n) with a rising voltage of the fourth node K(n) according to a control of the scan signal of the (n)th GOA unit G(n) and a control of the down clock signal CKD. The rising voltage of the fourth node K(n) is caused from a voltage of the scan signal of the (n)th GOA unit G(n) and a voltage of the third node J(n).

The pull-down unit 700 is electrically connected to the first node Q(n) and the second node H(n) and configured to receive the scan signal of the (n)th GOA unit G(n), a stage signal of a (n+2)th GOA unit Cout(n+2), a first low voltage VGL1, and a second low voltage VGL2 for pulling down the voltage of the first node Q(n) and a voltage of the second node H(n) to the first low voltage VGL1 and pulling down the voltage of the scan signal of the (n)th GOA unit G(n) to the second low voltage VGL2 according to a control of the stage signal of the (n+2)th GOA unit Cout(n+2).

The pull-down control unit 800 is electrically connected to the first node Q(n), the second node H(n), a fifth node P(n), and the sixth node F(n) and configured to receive the stage signal of the (n)th GOA unit Cout(n), the first low voltage VGL1, and the second low voltage VGL2 for keeping the voltage of the first node Q(n) and the voltage of the second node H(n) at the first low voltage VGL1, pulling down the voltage of the stage signal of the (n)th GOA unit Cout(n) to the first low voltage VGL1, and pulling down a voltage of the sixth node to the second low voltage according to a control of the fifth node.

Particularly, as shown in FIG. 1, in the preferable embodiment of the present disclosure, the pull-up control unit 100 includes a first thin-film transistor (TFT) T1 and a second TFT T2. A gate of the first TFT T1 is configured to receive the pull-up clock signal CKU. A source of the first TFT T1 is configured to receive the stage signal of the (n−1)th GOA unit Cout(n−1). A drain of the first TFT T1 is electrically connected to the second node H(n). A gate of the second TFT T2 is configured to receive the pull-up clock signal CKU. A source of the second TFT T2 is electrically connected to the second node H(n). A drain of the second TFT T2 is electrically connected to the first node Q(n).

Particularly, as shown in FIG. 1, in the preferable embodiment of the present disclosure, the hand-down 200 includes a third TFT T3. A gate of the third T3 is electrically connected to the first node Q(n). A source of the third T3 is configured to receive the output clock signal CKO. A drain of the third T3 is configured to output the stage signal of the (n)th GOA unit Cout(n).

Particularly, as shown in FIG. 1, in the preferable embodiment of the present disclosure, the feedback unit 300 includes a fourth TFT T4 and a fifth TFT T5. A gate of the fourth TFT T4 is electrically connected to the first node Q(n). A source of the fourth TFT T4 is configured to receive the output clock signal CKO. A drain of the fourth TFT T4 is electrically connected to the sixth node F(n). A gate of the fifth TFT T5 is configured to receive the stage signal of the (n)th GOA unit Cout(n). A source of the fifth TFT T5 is electrically connected to the second node H(n). A drain of the fifth TFT T5 is electrically connected to the sixth node F(n).

Particularly, as shown in FIG. 1, in the preferable embodiment of the present disclosure, the first pull-up unit 400 includes a sixth TFT T6. A gate of the sixth TFT T6 is electrically connected to the first node Q(n). A source of the sixth TFT T6 is configured to receive the output clock signal CKO. A drain of the sixth TFT T6 is configured to output the scan signal of the (n)th GOA unit G(n).

Particularly, as shown in FIG. 1, in the preferable embodiment of the present disclosure, the second pull-up unit 500 includes a seventh TFT T7. A gate of the seventh TFT T7 is electrically connected to the first node Q(n). A source of the seventh TFT T7 is configured to receive the down clock signal CKD. A drain of the seventh TFT T7 is electrically connected to the third node J(n).

Particularly, as shown in FIG. 1, in the preferable embodiment of the present disclosure, the bootstrap capacitor unit 600 includes a capacitor C1, an eighth TFT T8, and a ninth TFT T9. A first end of the capacitor C1 is electrically connected to the first node Q(n). A second end of the capacitor C1 is electrically connected to the fourth node K(n). A gate of the eighth TFT T8 is configured to receive the output clock signal CKO. A source of the eighth TFT T8 is electrically connected to the fourth node K(n). A drain of the eighth TFT T8 is configured to output the scan signal of the (n)th Goa unit G(n). A gate of the ninth TFT T9 is configured to receive the down clock signal CKD. A source of the ninth TFT T9 is electrically connected to the fourth node K(n). A drain of the ninth TFT T9 is electrically connected to the third node J(n).

Particularly, as shown in FIG. 1, in the preferable embodiment of the present disclosure, the pull-down unit 700 includes a tenth TFT T0, a eleventh TFT T11, and a twelfth TFT T12. A gate of the tenth TFT T10 is configured to receive the stage signal of the (n+2)th GOA unit Cout(n+2). A source of the tenth TFT T10 is configured to receive the scan signal of the (n)th GOA unit G(n). A drain of the tenth TFT T10 is configured to receive the second low voltage VGL2. A gate of the eleventh TFT T11 is configured to receive the stage signal of the (n+2)th GOA unit Cout(n+2). A source of the eleventh TFT T11 is electrically connected to the first node Q(n). A drain of the eleventh TFT T11 is electrically connected to the second node. A gate of the twelfth TFT T12 is configured to receive the stage signal of the (n+2)th GOA unit Cout(n+2). A source of the twelfth TFT T12 is electrically connected to the second node H(n). A drain of the twelfth TFT T12 is electrically connected to the first low voltage VGL1.

Particularly, as shown in FIG. 1, in the preferable embodiment of the present disclosure, the pull-down control unit 800 is electrically connected to the first node Q(n), the second node H(n), the fifth node P(n), and a sixth node F(n) and is configured to receive the stage signal of the (n)th GOA unit Cout(n), the first low voltage VGL1, and the second low voltage VGL2 for keeping the voltage of the first node Q(n) and the voltage of the second node H(n) at the first low voltage VGL1 and pulling down the voltage of the stage signal of the (n)th GOA unit Cout(n) to the first low voltage VGL1, and pulling down a voltage of the sixth node F(n) to the second low voltage VGL2 according to a control of the fifth node P(n).

Particularly, as shown in FIG. 1, in the preferable embodiment of the present disclosure, the pull-down control unit 800 includes a thirteenth TFT T13, a fourteenth TFT T14, a fifteenth TFT T15, a sixteenth TFT T16, a seventeenth TFT T17, a eighteenth TFT T18, a nineteenth TFT T19, a twentieth TFT T20, and a twenty-first TFT T21.

A gate of the thirteenth TFT T13 is electrically connected to the fifth node P(n). A source of the thirteenth TFT T13 is electrically connected to the second node H(n). A drain of the thirteenth TFT T13 is configured to receive the first low voltage VGL1.

A gate of the fourteenth TFT T14 is electrically connected to the fifth node P(n). A source of the fourteenth TFT T14 is electrically connected to the first node Q(n). A drain of the fourteenth TFT T14 is electrically connected to the second node H(n).

A gate of the fifteenth TFT T15 is electrically connected to the fifth node P(n). A source of the fifteenth TFT T15 is configured to receive the stage signal of the (n)th GOA unit Cout(n). A drain of the fifteenth TFT T15 is configured to receive the first low voltage VGL1.

A gate of the sixteenth TFT T16 is electrically connected to the fifth node P(n). A source of the sixteenth TFT T16 is electrically connected to the sixth node F(n). A drain of the sixteenth TFT is configured to receive the second low voltage VGL2.

A gate of the seventeenth TFT T17 is electrically connected to the fifth node P(n). A source of the seventeenth TFT T17 is electrically connected to the sixth node F(n). A drain of the seventeenth TFT T17 is configured to receive the second low voltage VGL2.

Both of a gate of the eighteenth TFT T18 and a source of the eighteenth TFT T18 are configured to receive a high voltage VGH. A drain of the eighteenth TFT T18 is electrically connected to a source of the ninetieth TFT T19.

A gate of the ninetieth TFT T19 is electrically connected to the first node Q(n). A drain of the ninetieth TFT T19 is configured to receive the first low voltage VGL1.

A gate of the twentieth TFT T20 is electrically connected to a source of the nineteenth TFT T19. A source of the twentieth TFT T20 is configured to receive the high voltage VGH. A drain of the twentieth TFT T20 is electrically connected to the fifth node P(n).

A gate of the twenty-first TFT T21 is electrically connected to the first node Q(n). A source of the twenty-first TFT T21 is electrically connected to the fifth node P(n). A drain of the twenty-first TFT T21 is configured to receive the first low voltage VGL1.

Figure 3:
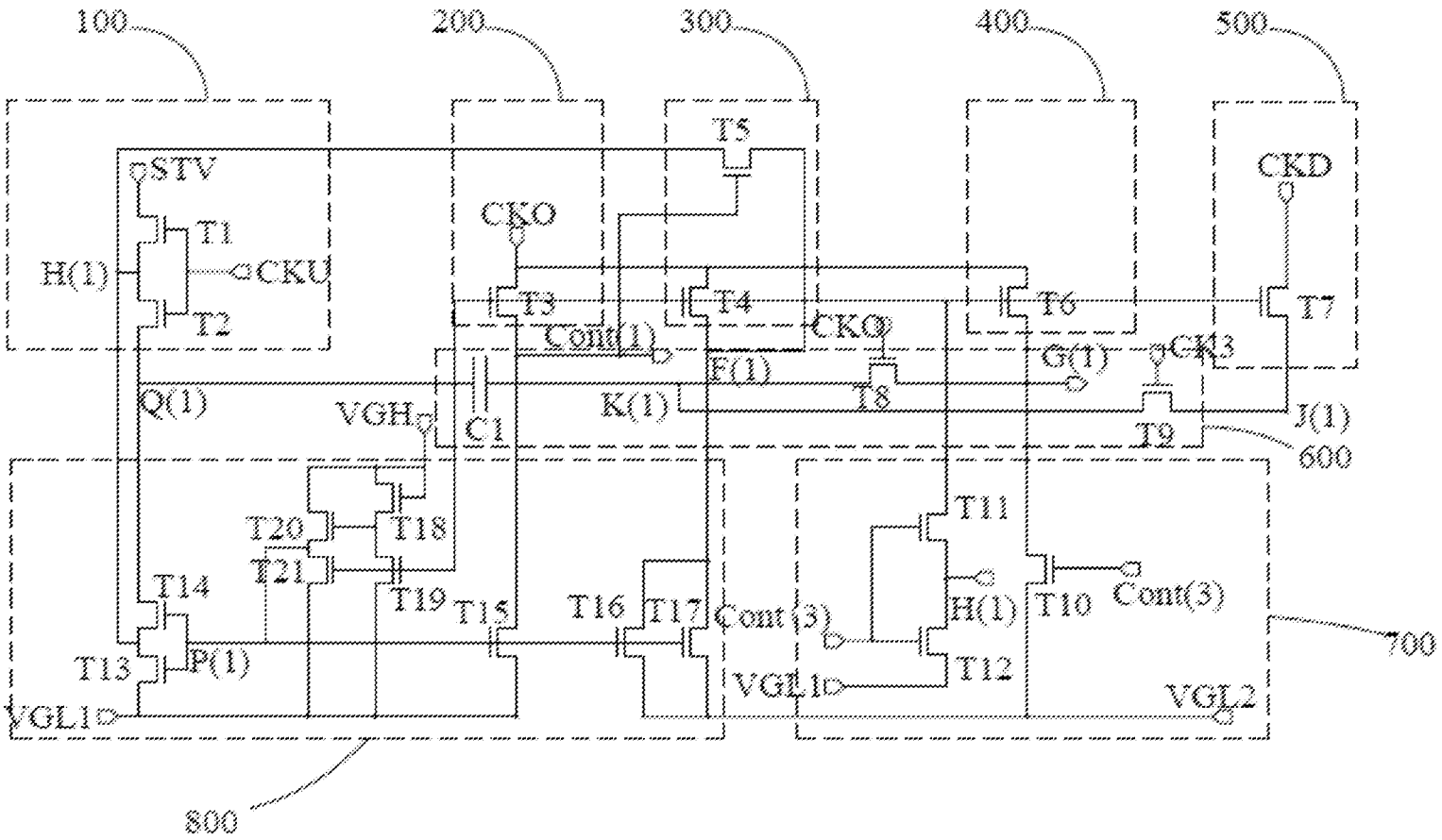
FIG. 3 illustrates a circuit of a first stage of GOA unit of the GOA circuit of the present disclosure.
Figure 4:
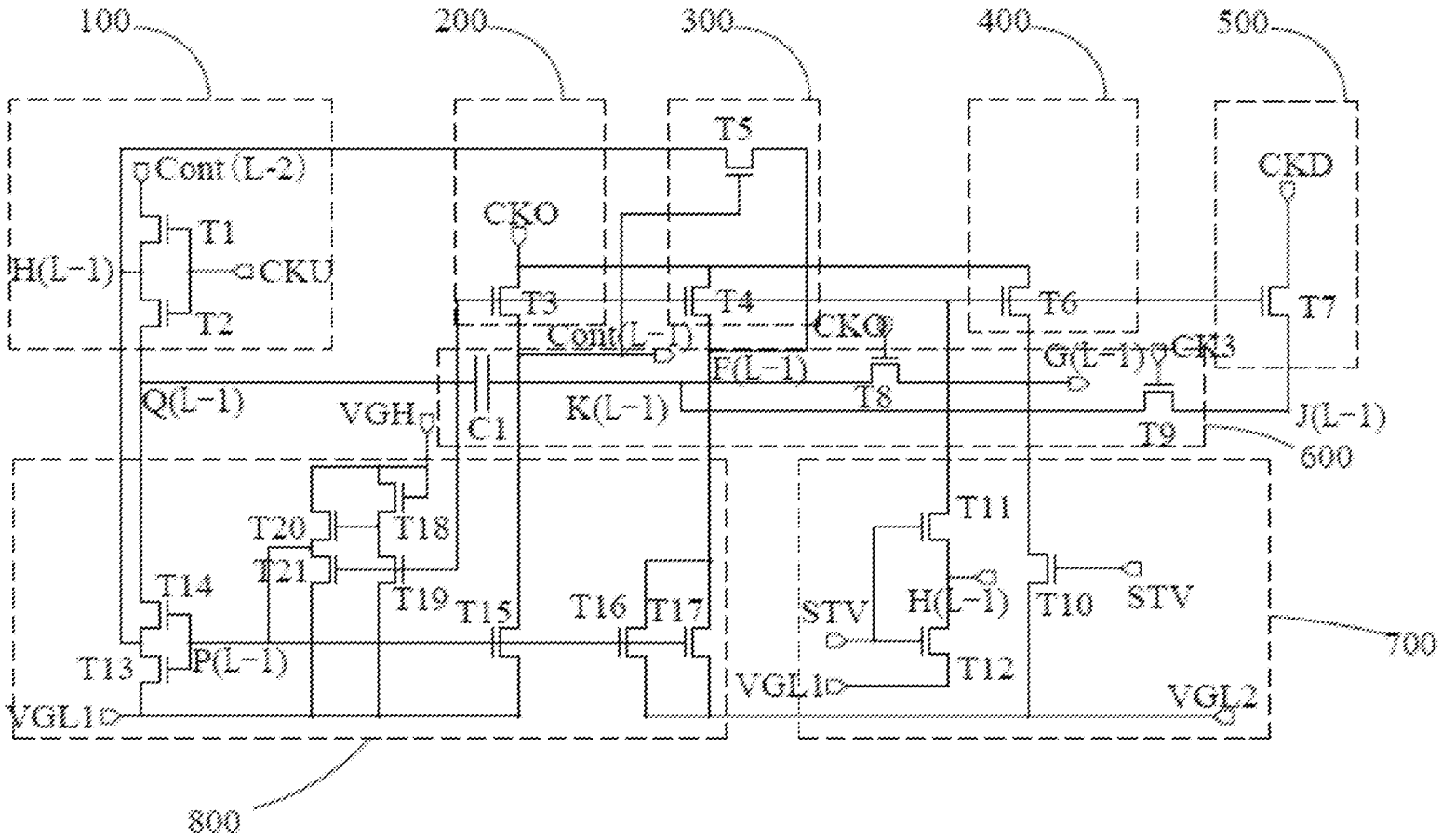
FIG. 4 illustrates a circuit of a last two stage of GOA unit of the GOA circuit of the present disclosure.
Figure 5:
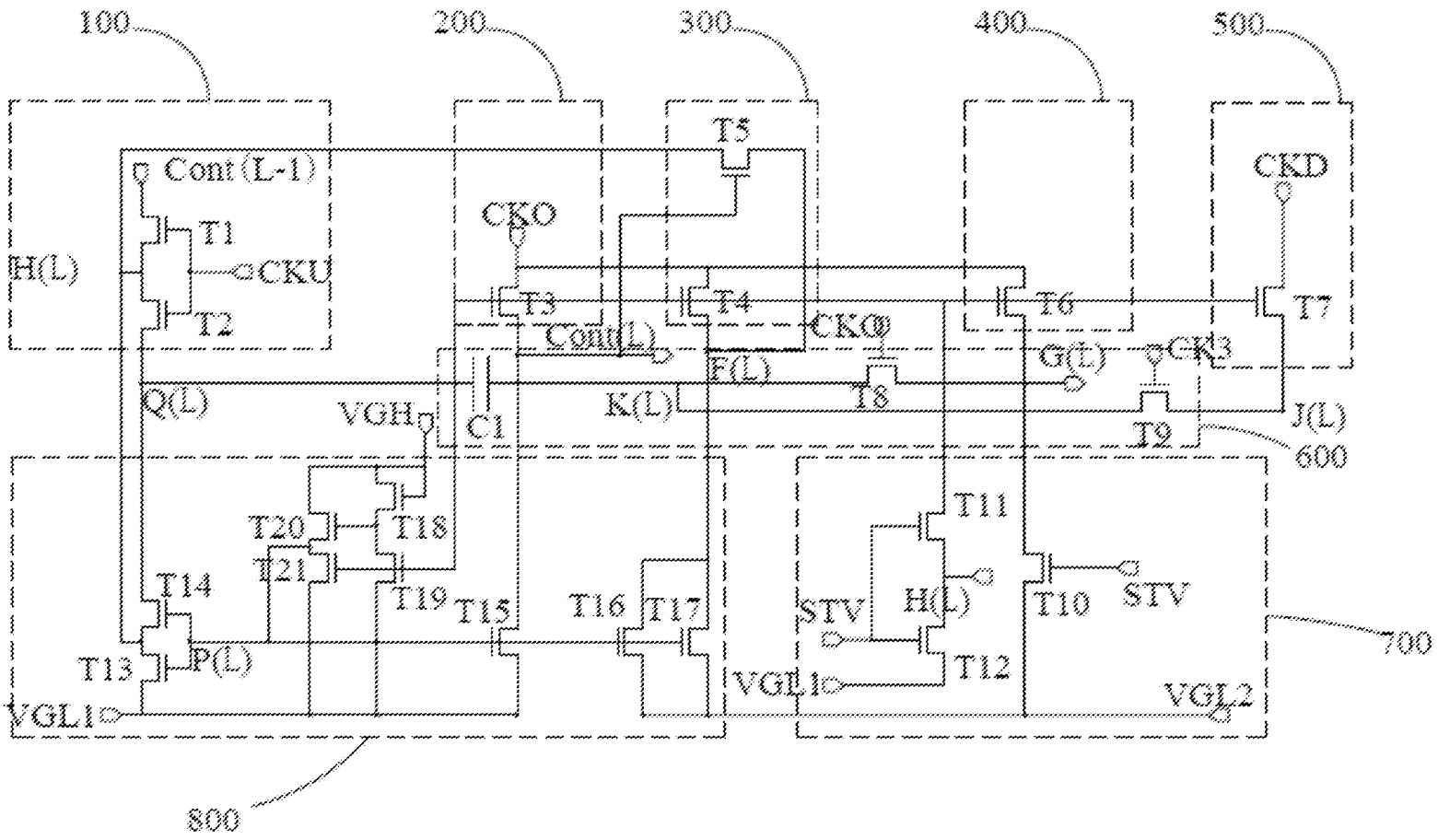
FIG. 5 illustrates a circuit of a last stage of GOA unit of the GOA circuit of the present disclosure.

Particularly, as shown in FIG. 3, in order to operate the circuit normally, a first stage of GOA unit of the GOA circuit of the present disclosure adopt starting signal STV, instead of stage signal of the (n−1)th GOA unit, as inputting signal to the pull-up control unit 100. In corresponding to the preferable embodiment of the present disclosure, in the first stage of the GOA unit, both of the gate of the first TFT T1 and the gate of the second TFT T2 are configured to receive the starting signal STY. As shown in FIG. 4 and FIG. 5, the last two stage of the GOA unit and the last stage of the GOA unit adopt the starting signal STV, instead of the stage signal of the (n+2)th GOA unit Cout(n+2), as inputting signal to the pull-down unit 400. In corresponding to the preferable embodiment of the present disclosure, in the last two stage of the GOA unit and the last stage of the GOA unit, the gate of the tenth TFT T10, the gate of the eleventh TFT T11, and the gate of the twelfth TFT T12 are configured to receive the starting signal STY.

Figure 2:
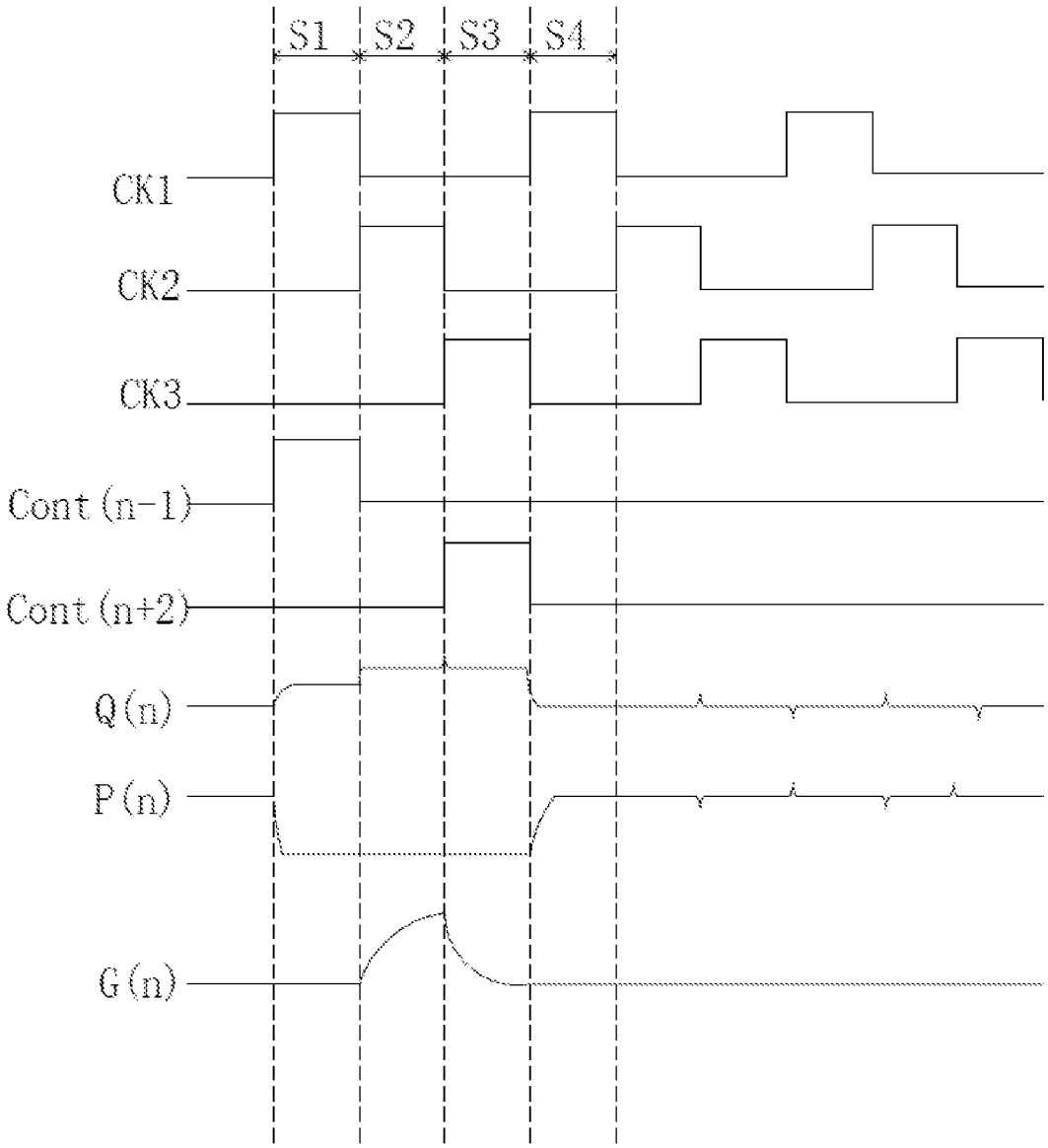
FIG. 2 illustrates waveforms of the Goa circuit of the present disclosure.

Preferably, as shown in FIG. 2, the GOA circuit of the present disclosure has three clock signals: a first clock signal CK1, a second clock signal CK2, and a third clock signal CK3. The first clock signal CK1, the second clock signal CK2, and the third clock signal CK3 become high voltage potentials in sequence. When X represents a positive integer, In (3X−2)th stage of GOA circuit, the pull-up clock signal CKU is the first clock signal CK1, the output clock signal CKO is the second clock signal CK2, and the down clock signal CKD is the third clock signal CK3. In (3X−1)th stage of GOA circuit, the pull-up clock signal is the second clock signal CK2, the output clock signal CKO is the third clock signal CK3, the down clock signal CKD is the first clock signal CK1. In (3X)th stage of GOA circuit, the pull-up clock signal is the third clock signal CK3, the output clock signal CKO is the first clock signal CK1, the down clock signal CKD is the second clock signal CK2.

Particularly, in the preferable embodiment of the present disclosure, a voltage potential of the starting signal STV is 20 V and a voltage potential of the low voltage is −10 V. High voltage potentials of the first clock signal CK1, the second clock signal CK2, and the third clock signal CK3 is 20 V. Low voltage potentials of the first clock signal CK1, the second clock signal CK2, and the third clock signal CK3 is −10 V. A voltage potential of the first low voltage VGL1 is −10 V and a voltage of the second low voltage VGL2 is −6 V.

Preferably, all of the TFTs in the GOA circuit of the present disclosure are metal oxide semiconductor thin film transistors, polysilicon thin film transistors or amorphous silicon thin film transistors. All of the TFTs in the GOA circuit of the present disclosure are all N-type thin film transistors.

Particularly, the eighteenth TFT T18, the nineteenth TFT T19, the twentieth TFT T20, and the twenty-first TFT T21 compose an inverter.

Please refer to FIG. 1 and FIG. 2. Take the preferable embodiment of the present disclosure as an example, in the (n)th GOA unit, the pull-up clock signal CKU is the first clock signal. The output clock signal CKO is the second clock signal CK2. The down clock signal CKD is the third clock signal CK3. The operating processes are as following.

In period S2: when the first clock signal is at the high voltage potential, the first TFT T1 and the second TFT T2 are turned on. In the meanwhile, the stage signal of the (n−1)th GOA unit Cout(n−1) is at the high voltage potential. Hence, a voltage potential of the first node Q(n) is risen. The third TFT T3, the fourth TFT T4, the sixth TFT T6, the seventh TFT T7, the nineteenth TFT T19 and the twenty-first TFT T21 are turned on. A voltage potential of the fifth node P(n) is pulled down to the low voltage potential. The thirteenth TFT T13, the fourteenth TFT T14, the fifteenth TFT T15, the sixteenth TFT T16, and the seventeenth TFT T17 are turned off. The second clock signal CK2 is at the low voltage potential. The stage signal of the (n)th GOA unit Cout (n) and the scan signal of the (n)th GOA unit are at the low voltage potential. The third clock signal CK3 is at low voltage potential. The eighth TFT T8 and the ninth TFT T9 are turned off. The fourth node K(n) is at the low voltage potential.

In period S2: The first clock signal CK1 is declined to the low voltage potential. The first TFT T1 and the second TFT T2 are turn off. The second clock signal CK2 becomes the high voltage potential. The stage signal of the (n)th GOA unit Cout (n) and the scan signal of the (n)th GOA unit are risen to the high voltage potential. The eighth TFT T8 is turned on. The voltage potential of the fourth node K(n) is risen to the high voltage potential from the low voltage potential. Under the effect of the capacitor C1, the first node Q(n) is coupled to a higher voltage potential (38 V).

In period S3: The second clock signal CK2 is declined to the low voltage potential.

The eighth TFT T8 is turned off. The voltage potential of the third clock signal CK3 is risen to the high voltage potential. The ninth TFT T9 is turned on. The high voltage potential of the third clock signal CK3 is inputted to the fourth node K(n) for keeping the fourth node (n) being at the high voltage potential. The first node Q(n) keep being coupled to the higher voltage potential (38 V).

In period S4: The voltage potential of the first clock signal CK1 is risen to the high voltage potential. The first TFT T1 and the second TFT T2 are turned on. A voltage potential of the stage signal of the (n+2)th GOA unit becomes the high voltage potential. The tenth TFT T10, the eleventh TFt T11, and the twelfth TFT T12 are turned on. The voltage potential of the first node Q(n) is pulled down to the first low voltage VGL1. In the meanwhile, due to the inverter composed by the eighteenth TFT T18, the nineteenth TFT T19, the twentieth TFT T20, and the twenty-first TFT T21, the voltage potential of the fifth node P(n) is risen to the high voltage potential.

In the above-mentioned operations, the waveform of the voltage potential of the first node Q(n) is not symmetrical. The left part represents the period S1, the highest part represents the period S2, and the right part represents the period S3. The voltage potentials of the first node Q(n) in period S2 and S3 are kept at higher voltage potential. Therefore, the decline time of the scan signal becomes shorter and the performance of the GOA circuit is improved. The decline time of the scan signal in the present technology is usually about 7.5 μs. The decline time of the scan signal in the present disclosure is about 6.2 μs which is obviously shorter than decline time of the present technology.

To conclude, the present disclosure provides the GOA circuit. Each stage of GOA units of the GOA circuit includes the pull-up control unit, the hand-down unit, the feedback unit, the first pull-up unit, the second pull-up unit, the bootstrap capacitor unit, the pull-down unit, and the pull-down control unit. The bootstrap capacitor and the second pull-up unit of the GOA circuit make the first node have a non-symmetrical waveform. The right part of the waveform is as high as the highest voltage potential of the first node so that the decline time of the scan signal is reduced and the performance of the GOA circuit is improved.

As above-mentioned description, variations and modifications can be obtained by a skilled person in the art according to the technical solutions and technical concepts fall in the protected scope of the present disclosure.

What is claimed is:

1. A gate on array (GOA) circuit comprising a plurality stages of cascaded GOA units, and each of the GOA units comprising a pull-up control unit, a hand-down unit, a feedback unit, a first pull-up unit, a second pull-up unit, a bootstrap capacitor unit, a pull-down unit, and a pull-down control unit;

wherein n is an integer more than 1, in a (n)th GOA unit:

the pull-up control unit is electrically connected to a first node and a second node and configured to receive a stage signal of a (n−1)th GOA unit and a pull-up clock signal for outputting the stage signal of a (n−1)th GOA unit to the first noted and the second node according to a control of the pull-up clock signal;

the hand-down unit is electrically connected to the first node and configured to receive an output clock signal for outputting the output clock signal as a stage signal of a (n)th GOA unit according to a control of the first node;

the feedback unit is electrically connected to the first node, the second node, and a sixth node and configured to receive the output clock signal and the stage signal of the (n)th GOA unit for outputting the output clock signal to the sixth node and the second node according to a control of the stage signal of the (n)th GOA unit and the control of the first node;

the first pull-up unit is electrically connected to the first node and configured to receive the output clock signal for outputting the output clock signal as a scan signal of the (n)th GOA unit according to the control of the first node;

the second pull-up unit is electrically connected to the first node and a third node and configured to receive a down clock signal for outputting the down clock signal to the third node according to the control of the first node;

the bootstrap capacitor unit is electrically connected to the first node, a fourth node, and the third node and configured to receive the scan signal of the (n)th GOA unit, the output clock signal, and the down clock signal for pulling up a voltage of the first node with a rising voltage of the fourth node according to a control of the scan signal of the (n)th GOA unit and a control of the down clock signal, and the rising voltage of the fourth node is caused from a voltage of the scan signal of the (n)th GOA unit and a voltage of the third node;

the pull-down unit is electrically connected to the first node and the second node and configured to receive the scan signal of the (n)th GOA unit, a stage signal of a (n+2)th GOA unit, a first low voltage, and a second low voltage for pulling down the voltage of the first node and a voltage of the second node to the first low voltage and pulling down the voltage of the scan signal of the (n)th GOA unit to the second low voltage according to a control of the stage signal of the (n+2)th GOA unit;

the pull-down control unit is electrically connected to the first node, the second node, a fifth node, and the sixth node and configured to receive the stage signal of the (n)th GOA unit, the first low voltage, and the second low voltage for keeping the voltage of the first node and the voltage of the second node at the first low voltage and pulling down the voltage of the stage signal of the (n)th GOA unit to the first low voltage, and pulling down a voltage of the sixth node to the second low voltage according to a control of the fifth node.

2. The GOA circuit according claim 1, wherein the pull-up control unit comprises a first transistor and a second transistor;

a gate of the first transistor is configured to receive the pull-up clock signal, a source of the first transistor is configured to receive the stage signal of the (n−1)th GOA unit, and a drain of the first transistor is electrically connected to the second node;

a gate of the second transistor is configured to receive the pull-up clock signal, a source of the second transistor is electrically connected to the second node, and a drain of the second transistor is electrically connected to the first node.

3. The GOA circuit according to claim 1, wherein the hand-down unit comprises a third transistor; a gate of the third transistor is electrically connected to the first node, a source of the third transistor is configured to receive the output clock signal, and a drain of the third transistor outputs the stage signal of the (n)th GOA unit.

4. The GOA circuit according to claim 1, wherein the feedback unit comprises a fourth transistor and a fifth transistor;

a gate of the fourth transistor is electrically connected to the first node, a source of the fourth transistor is configured to receive the output clock signal, and a drain of the fourth transistor is electrically connected to the sixth node;

a gate of the fifth transistor is configured to receive the stage signal of the (n)th GOA unit, source of the fifth transistor is electrically connected to the second node, and a drain of the fifth transistor is electrically connected to the sixth node.

5. The GOA circuit according to claim 1, where the first pull-up unit comprises a sixth transistor; a gate of the sixth transistor is electrically connected to the first node, a source of the sixth transistor is configured to receive the output clock signal, and a source of the sixth transistor outputs the scan signal of the (n)th GOA unit.

6. The GOA circuit according to claim 1, wherein the second pull-up unit comprises a seventh transistor;

a gate of the seventh transistor is electrically connected to the first node, a source of the seventh transistor is configured to receive the down clock signal, and a source of the seventh transistor is electrically connected to the third node.

7. The GOA circuit according to claim 1, wherein the bootstrap capacitor unit comprises a capacitor, an eighth transistor, and a ninth transistor;

a first end of the capacitor is electrically connected to the first node and a second end of the capacitor is electrically connected to the fourth node;

a gate of the eighth transistor is configured to receive the output clock signal, a source of the eighth transistor is electrically connected to the fourth transistor, and a drain of the eighth transistor is configured to receive the scan signal of the (n)th GOA unit;

a gate of the ninth transistor is configured to receive the down clock signal, a source of the ninth transistor is electrically connected to the fourth node, and a drain of the ninth transistor is electrically connected to the third node.

8. The GOA circuit according claim 1, wherein the pull-down unit comprises a tenth transistor, an eleventh transistor, and a twelfth transistor;

a gate of the tenth transistor is configured to receive the stage signal of the (n+2)th GOA unit, a source of the tenth transistor is configured to receive the scan signal of the (n)th GOA unit, and a drain of the tenth transistor is configured to receive the second low voltage;

a gate of the eleventh transistor is configured to receive the stage signal of the (n+2)th GOA unit, a source of the eleventh transistor is electrically connected to the first node, and a drain of the eleventh transistor is electrically connected to the second node;

a gate of the twelfth transistor is configured to receive the stage signal of the (n+2)th GOA unit, a source of the twelfth transistor is electrically connected to the second node, and a drain of the twelfth transistor is electrically connected to the first low voltage.

9. The GOA circuit according to claim 1, wherein the pull-down control unit comprises a thirteenth transistor, a fourteenth transistor, a fifteenth transistor, a sixteenth transistor, a seventeenth transistor, a eighteenth transistor, a nineteenth transistor, a twentieth transistor, and a twenty-first transistor;

a gate of the thirteenth transistor is electrically connected to the fifth node, a source of the thirteenth transistor is electrically connected to the second node, and a drain of the thirteenth transistor is configured to receive the first low voltage;

a gate of the fourteenth transistor is electrically connected to the fifth node, a source of the fourteenth transistor is electrically connected to the first node, and a drain of the fourteenth transistor is electrically connected to the second node;

a gate of the fifteenth transistor is electrically connected to the fifth node, a source of the fifteenth transistor is configured to receive the stage signal of the (n)th GOA unit, and a drain of the fifteenth transistor is configured to receive the first low voltage;

a gate of the sixteenth transistor is electrically connected to the fifth node, a source of the sixteenth transistor is electrically connected to the sixth node, and a drain of the sixteenth transistor is configured to receive the second low voltage;

a gate of the seventeenth transistor is electrically connected to the fifth node, a source of the seventeenth transistor is electrically connected to the sixth node, and a drain of the seventeenth transistor is configured to receive the second low voltage;

both of a gate of the eighteenth transistor and a source of the eighteenth transistor are configured to receive a high voltage and a drain of the eighteenth transistor is electrically connected to a source of the ninetieth transistor;

a gate of the ninetieth transistor is electrically connected to the first node and a drain of the ninetieth transistor is configured to receive the first low voltage;

a gate of the twentieth transistor is electrically connected to a source of the nineteenth transistor, a source of the twentieth transistor is configured to receive the high voltage, and a drain of the twentieth transistor is electrically connected to the fifth node;

a gate of the twenty-first transistor is electrically connected to the first node, a source of the twenty-first transistor is electrically connected to the fifth node, and a drain of the twenty-first transistor is configured to receive the first low voltage.

10. The GOA circuit according to claim 1, wherein the second low voltage is lower than the first low voltage.

* * * * *